US009848695B1

(12) United States Patent
Gauss

(10) Patent No.: US 9,848,695 B1
(45) Date of Patent: Dec. 26, 2017

(54) SPRING TABLE

(71) Applicant: GSI Outdoors, Inc., Spokane, WA (US)

(72) Inventor: Kurt Gauss, Spokane, WA (US)

(73) Assignee: GSI Outdoors, Inc., Spokane, WA (US)

( * ) Notice: Subject to any disclaimer, the term of this patent is extended or adjusted under 35 U.S.C. 154(b) by 0 days.

(21) Appl. No.: 15/401,724

(22) Filed: Jan. 9, 2017

(51) Int. Cl.

| | |
|---|---|
| ***A47B 3/00*** | (2006.01) |
| ***A47B 3/08*** | (2006.01) |
| ***A47B 3/083*** | (2006.01) |
| ***A47B 3/10*** | (2006.01) |
| ***A47B 37/04*** | (2006.01) |

(52) U.S. Cl.
CPC ..... *A47B 3/0809* (2013.01); *A47B 3/083* (2013.01); *A47B 3/10* (2013.01); *A47B 37/04* (2013.01); *A47B 2003/0824* (2013.01)

(58) Field of Classification Search
CPC ..... A47B 3/0809; A47B 3/002; A47B 3/02; A47B 3/08; A47B 3/083; A47B 2003/025; A47B 2003/0821; A47B 2003/0824; A47B 2003/0827
See application file for complete search history.

(56) References Cited

U.S. PATENT DOCUMENTS

| | | | | |
|---|---|---|---|---|
| 2,717,028 A | | 9/1955 | Villemure | |
| 2,871,075 A | * | 1/1959 | Stone | A47B 3/02 108/119 |
| 2,983,308 A | | 5/1961 | Horowitz | |
| 3,074,770 A | | 1/1963 | Joos | |
| 3,103,900 A | * | 9/1963 | Lippman | A47B 3/02 108/10 |
| 3,565,019 A | * | 2/1971 | Bedol | A47B 3/02 108/120 |
| 4,187,785 A | * | 2/1980 | Juh | A47B 3/083 108/36 |
| 6,523,485 B1 | * | 2/2003 | Cipolla | A45B 23/00 108/14 |
| 7,707,948 B2 | | 5/2010 | Lin | |
| 7,757,616 B2 | | 7/2010 | Cohen | |
| 9,532,645 B1 | * | 1/2017 | Lin | A47B 9/16 |
| 2003/0233966 A1 | * | 12/2003 | Zheng | A47B 3/02 108/115 |
| 2004/0237849 A1 | * | 12/2004 | Zhurong | A47B 3/0912 108/35 |
| 2012/0285351 A1 | | 11/2012 | Cohen | |
| 2013/0228103 A1 | * | 9/2013 | Eveleth | A47B 3/08 108/115 |

FOREIGN PATENT DOCUMENTS

| | | |
|---|---|---|
| EP | 2422646 B1 | 7/2015 |

* cited by examiner

*Primary Examiner* — Daniel J Rohrhoff
(74) *Attorney, Agent, or Firm* — Randall Danskin P.S.

(57) ABSTRACT

A folding portable table having a planar table top with a first half and a hingedly connected second half. A hinge fixedly connected to each table top half along adjoining side portions to allow the planar table top to fold along the hinge. A leg assembly bracket fixedly carried on a bottom surface of each table top half, each leg assembly bracket defining a first concave notch and a second concave notch, each concave notch configured to engage with and positionally maintain a leg assembly. Two leg assemblies for releasable engagement with the leg assembly brackets to support the folding portable table above a supporting surface and for storage adjacent a bottom surface of each table top half when folded.

15 Claims, 9 Drawing Sheets

SPRING TABLE

TECHNICAL FIELD

The present invention relates generally to support structures and tables. More particularly, the present invention relates to a folding portable table for use in camping and outdoor activities.

BACKGROUND OF THE INVENTION

When engaging in outdoor activities such as camping and picnicking and the like, it is often desirable to have a stable planar support surface upon which to set drinking vessels such as cups, and wine glasses as well as pots, pans, plates and utensils used for cooking that users do not want to place on the ground where they may become dirty and unsanitary.

Tables are well known, but have the drawback of being difficult to transport, difficult to assemble, and being heavy and bulky.

The instant invention is a portable folding table for use in camping and picnicking activities that is lightweight, durable, strong and self-contained. The instant invention provides a planar table surface that is strong enough to support pots, pans, plates, cooking utensils and drinking vessels and is small and portable enough to be used in backpacking activities, and other activities were a stable planar surface above the ground is desirable.

SUMMARY OF THE INVENTION

A folding portable table comprising a planar table top having a first half and a hingedly connected second half, each half having a first end portion, a second end portion, an outer side portion and an inner side portion, each half further having a top surface, and a bottom surface; a hinge fixedly connected to each table top half along adjoining side portions to allow the planar table top to fold along the hinge; a leg assembly bracket fixedly carried on the bottom surface of each table top half, each leg assembly bracket defining a first concave notch, and a second concave notch, each concave notch configured to engage with and positionally maintain a leg assembly; and a leg assembly for releasable engagement with the leg assembly brackets to support the folding portable table above a supporting surface, each leg assembly having a first foot and a spaced apart second foot, an outer edge top rail and an inner top rail and having legs communicating from opposing end portions of the outer edge top rail and the inner top rail with the first foot and with the second foot.

A further aspect of the present invention is a folding portable table further comprising a storage latch carried by the table top halves to secure the table top halves in a storage configuration.

A further aspect of the present invention is a folding portable table further comprising a perpendicular lip extending along the laterally outer side portion of each table top half.

A further aspect of the present invention is a folding portable table further comprising a medial bend in the inner top rail of the leg assembly and a medial bend in the outer edge top rail of the leg assembly to facilitate aligned engagement with the leg assembly brackets.

A further aspect of the present invention is a folding portable table further comprising a rotation leg defined in each leg assembly bracket adjacent the second concave notch to engage with the medial bend in the inner top rail to facilitate rotational alignment of the leg assembly relative to the table top.

A further aspect of the present invention is a folding portable table further comprising an offset leg on at least one of the leg assembly brackets, the offset leg defining a storage concave notch to positionally secure the leg assembly adjacent the bottom surface of the table top half when the leg assembly is in a storage configuration.

A further aspect of the present invention is a folding portable table wherein the hinge is plural spacedly arrayed hinge barrels structurally carried along the laterally inner side portion of each table half and each of the plural hinge barrels defines a medial channel extending elongately therethrough to carry a hinge pin therein and the plural spacedly arrayed hinge barrels carried on the laterally inner side portion of the first table top half are complimentary spaced with the plural spacedly arrayed hinge barrels carried on the laterally inner side portion of the second table top half so that the medial channels defined by the plural hinge barrels of both table halves are axially aligned when the first table half and the second table half are oriented adjacent one another so that the hinge pin extends simultaneously through the aligned medial channels to hingedly interconnect the first table top half with the second table top half to allow folding of the portable table. A further aspect of the present invention is a folding portable table wherein each leg assembly bracket is located proximate the first end portion and proximate the second end portion.

A further aspect of the present invention is a folding portable table wherein the first foot having a first leg communicating with an inner top rail, opposite the first foot, and the first foot further has a second leg communicating with an outer edge top rail, opposite the first foot, the second foot also having a first leg communicating with the inner top rail, opposite the second foot, and the second foot further has a second leg communicating with the outer edge top rail, opposite the second foot.

A further aspect of the present invention is a folding portable table wherein the inner top rail and the outer edge top rail of each spring leg assembly releasably engage with the first concave notch and the second concave notch of the leg assembly bracket to extend angularly from the bottom of the table top halves to support the table top halves above a supporting surface, and retentive memory of spring steel material forming the spring leg assemblies causes the spring leg assemblies to be positionally secured to the leg assembly brackets.

A further aspect of the present invention is a folding portable table wherein the leg assemblies are formed of a material having retentive memory.

A further aspect of the present invention is a folding portable table wherein the leg assemblies are formed of spring steel.

A further aspect of the present invention is a folding portable table wherein an anti-slip coating is carried on the first foot and the second foot.

A still further aspect of the present invention is a folding portable table comprising a planar table top having a first half and a hingedly connected second half, each table top half having a first end portion and a spaced apart second end portion, a laterally outer side portion and a spaced apart laterally inner side portion, each table top half further having a top surface, an opposing bottom surface and a perpendicular lip extending along the laterally outer side portion; plural spacedly arrayed hinge barrels structurally carried along the laterally inner side portion of each table half and each of the plural hinge barrels defines a medial channel extending elongately therethrough to carry a hinge pin therein and the plural spacedly arrayed hinge barrels carried on the laterally inner side portion of the first table top half are complimentary spaced with the plural spacedly arrayed hinge barrels carried on the laterally inner side portion of the second table top half so that the medial channels defined by the plural hinge barrels of both table halves are axially aligned when the first table half and the second table half are oriented adjacent one another so that the hinge pin extends simultaneously through the aligned medial channels to hingedly interconnect the first table top half with the second table top half to allow folding of the portable table; a leg assembly bracket fixedly carried on the bottom surface of each table top half proximate the first end portion and proximate the second end portion, each leg assembly bracket defining a first concave notch, and a spaced apart second concave notch, each concave notch configured to engage with and positionally maintain a spring leg assembly; a spring leg assembly for releasably engagement with the leg assembly brackets at each end of each table top half, each spring leg assembly having a first foot and a spaced apart second foot, the first foot having a first leg communicating with an inner top rail, opposite the first foot, and the first foot further has a second leg communicating with an outer edge top rail, opposite the first foot, the second foot also having a first leg communicating with the inner top rail, opposite the second foot, and the second foot further has a second leg communicating with the outer edge top rail, opposite the second foot; and the inner top rail and the outer edge top rail of each spring leg assembly releasably engage with the first concave notch and the second concave notch of the leg assembly bracket to extend angularly from the bottom of the table top halves to support the table top halves above a supporting surface, and retentive memory of spring steel material forming the spring leg assemblies causes the spring leg assemblies to be positionally secured to the leg assembly brackets.

An even still further aspect of the present invention is a folding portable table of further comprising an offset leg on at least one of the leg assembly brackets, the offset leg defining a storage concave notch to positionally secure the leg assembly adjacent the bottom surface of the table top half when the leg assembly is in a storage configuration.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

A folding portable table generally provides a first leg assembly 9A a second leg assembly 9B and a table top 30 having a first half 3A and a hingedly interconnected second half 30B.

The folding portable table is supported on an underlying surface 100 which may be the ground, or another supporting surface such as a table or the like (not shown).

The first leg assembly 9A, is identical in form and configuration to the second leg assembly 9B and therefore only one leg assembly 9A, 9B will be described in detail herein. Each leg assembly 9A, 9B is preferably formed of a strong resilient material which has rigidity and retentive memory, such as, but not limited to spring steel or stainless steel. It is also contemplated that such material may also be a polymer (not shown) or a plastic (not shown) so that corrosion and rust does not develop upon the material during and subsequent to use in damp/wet conditions.

Figure 10:
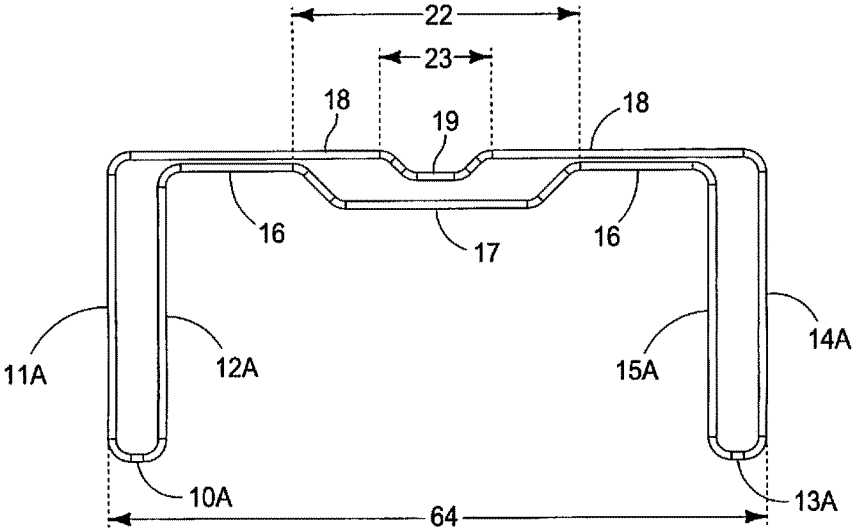
FIG. 10 is an orthographic front view of a leg assembly removed from the table top.

As shown in FIG. 10, each leg assembly 9A, 9B has a first foot 10A that is arcuate in form and a second foot 13A that is also arcuate in form and is spaced apart from the first foot 10A. Each foot 10A, 13A may have a slip resistant coating/covering there on or thereover, such as, but not limited to rubber or plastic to provide an anti-slip engagement with the supporting surface 100. The first foot 10A structurally communicates with a first leg 11A and also with a second leg 12A which both extend generally upwardly and perpendicularly from the first foot 10A. Opposite the first foot 10A, the first leg 11A structurally communicates with an elongate inner top rail 18 that extends to and structurally communicates with an end portion of first leg 14A which communicates with the second foot 13A opposite the inner top rail 18. Second leg 12A of first foot 10A structurally communicates, opposite the first foot 10A, with an elongate outer edge top rail 16 that similarly extends to and communicates with an end of second leg 15A that communicates with the second foot 13A. The outer edge top rail 16 and the inner top rail 18 are oriented parallel to one another, and closely adjacent, and are both spaced apart from the first foot 10A and the second foot 13A by the length (not shown) of the legs 11, 12, 14, 15. The legs 11, 12, 14, 15 and the feet 10, 13 and the top rails 16, 18 are all interconnected at adjacent end portions so that each leg assembly 9A, 9B forms an endless loop, which provides strength and rigidity.

Figure 5:
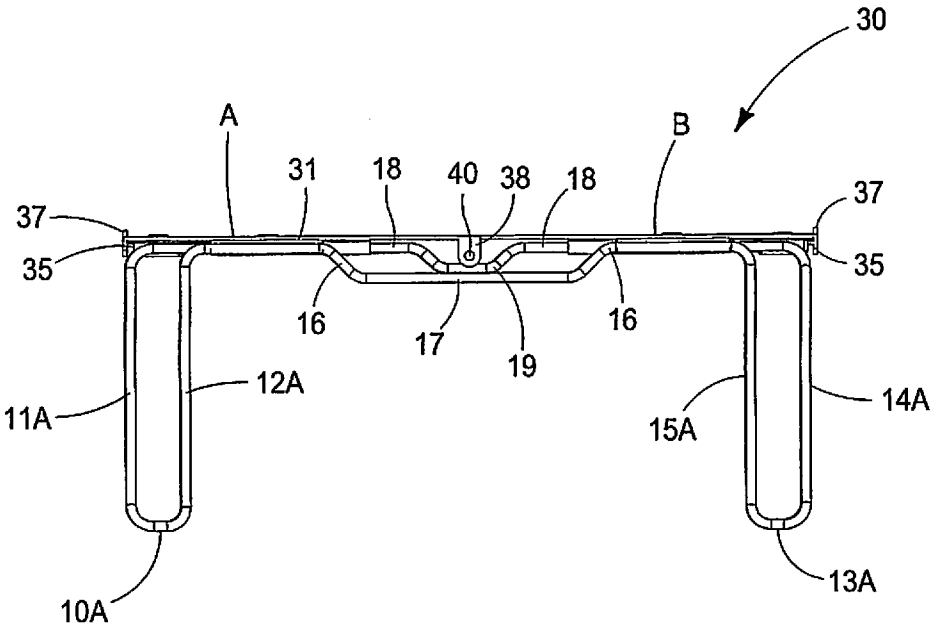
FIG. 5 is an orthographic end view of the table of FIG. 1.

The outer edge top rail 16 defines a medial bend 17 therein, and the medial bend 17 extends in the direction toward the first foot 10A and the second foot 13A. The medial bend 17 accommodates hinge barrels 38 carried by the table 30 when the leg assembly 9A is engaged with the table 30 in a standing position. (FIG. 5). Similarly, the inner top rail 18 defines a medial downward bend 19 that extends toward the first foot 10A and the second foot 13A. As shown in FIG. 10, length 22 of the medial bend 17 defined in the outer edge top rail 16 is greater than length 23 of the medial bend 19 defined by the inner top rail 18. The larger length 22 of medial bend 17 assists in positionally securing the leg assembly 9A, 9B to leg assembly brackets 50 carried on a bottom surface 32 of the table top halves 30A, 30B.

Figure 7:
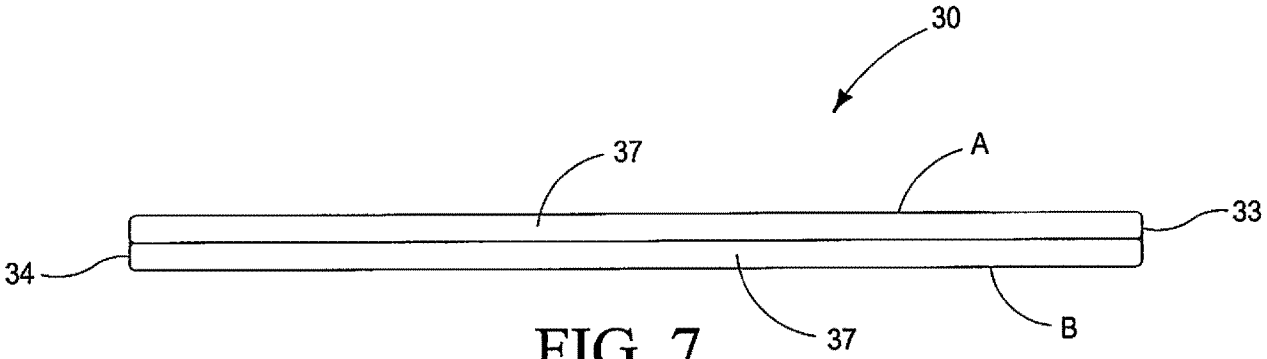
FIG. 7 is an orthographic side view of the instant folding portable table in a folded/storage/transport configuration.
Figure 8:
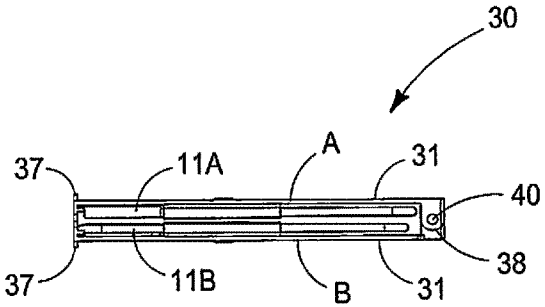
FIG. 8 is an orthographic end view of the folded table of FIG. 7.
Figure 9:
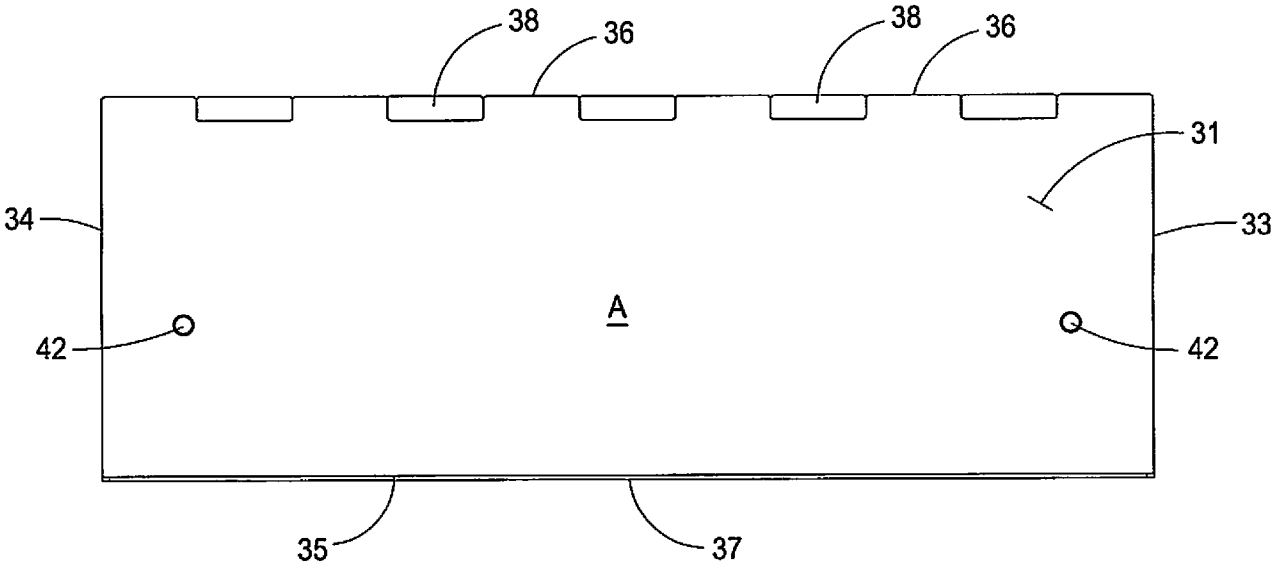
FIG. 9 is an orthographic top, downward looking view, of the folded table of FIG. 7.

The table 30 is generally planar in configuration and has a first table top half 30A and a second table top half 30B. The two halves 30A, 30B are similar in structure and configuration, each having a top surface 31, a bottom surface 32, a first end portion 33, a second end portion 34, a laterally outer side 35 and a laterally inner side 36. A perpendicularly extending lip 37 is carried on each laterally outer side 35 of each half 30A, 30B. The lip 37 extends above the top surface 31 and below the bottom surface 32 and provides an edge that prevents items placed on the top surface 31 from sliding laterally there-off. The lip 37 further provides a "recess" (FIG. 8) into which the leg assemblies 9A, 9B may be securely stored when the folding table 30 is in a folded storage/transport configuration. (FIGS. 7, 8, 9).

Plural spacedly arrayed hinge barrels 38 are carried on the laterally inner side 36 of each table top half 30A, 30B. The hinge barrels 38 are structurally carried by the table top halves 30A, 30B and extend generally downwardly from the laterally inner side 36 below the bottom surface 32. Each of the spacedly arrayed hinge barrels 38 defines a medial channel (not shown) extending elongately therethrough for carriage of a hinge pin 40. The hinge barrels 38 and the hinge pin 40 cooperate with one another allowing table top half 30A to hingedly pivot relative to the table top half 30B so that the table 30 may be folded about the hinge pin 40 into a compact travel configuration as shown in FIGS. 7, 8, 9. The spaced array of the hinge barrels 38 on the table top halves 30A, 30B are cooperatively aligned so that the medial channels (not shown) defined by the hinge barrels 38 are axially aligned to facilitate the hinge pin 40 extending simultaneously therethrough.

Figure 1:
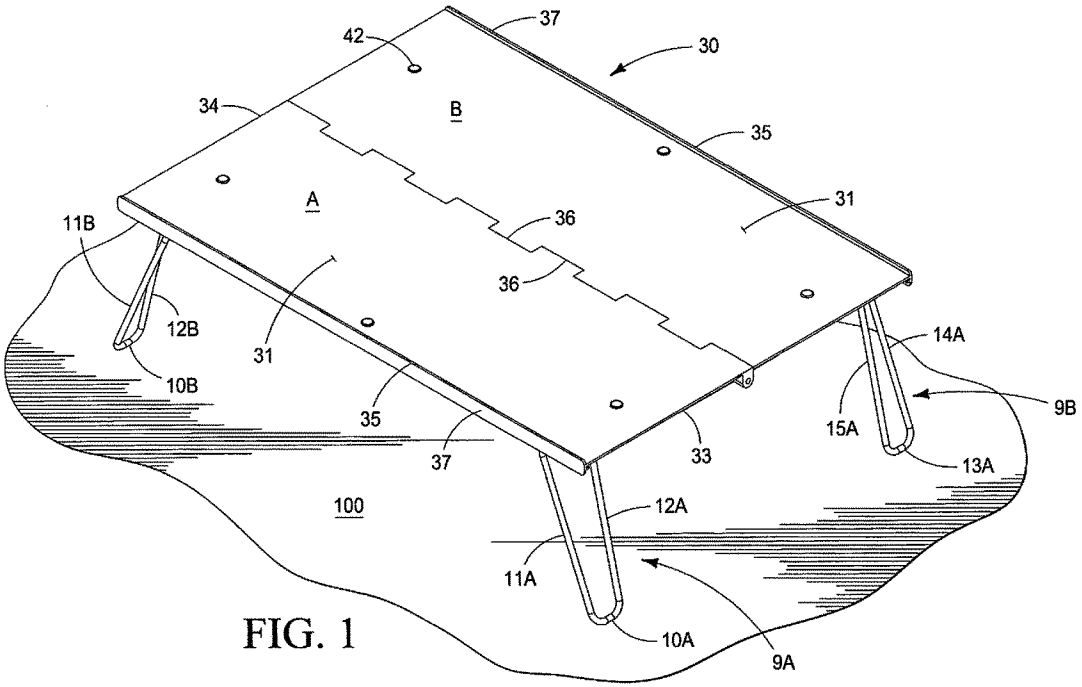
FIG. 1 is an isometric top, side and end view of the instant folding portable table, in an assembled/use configuration, on a supporting underlying surface.
Figure 4:
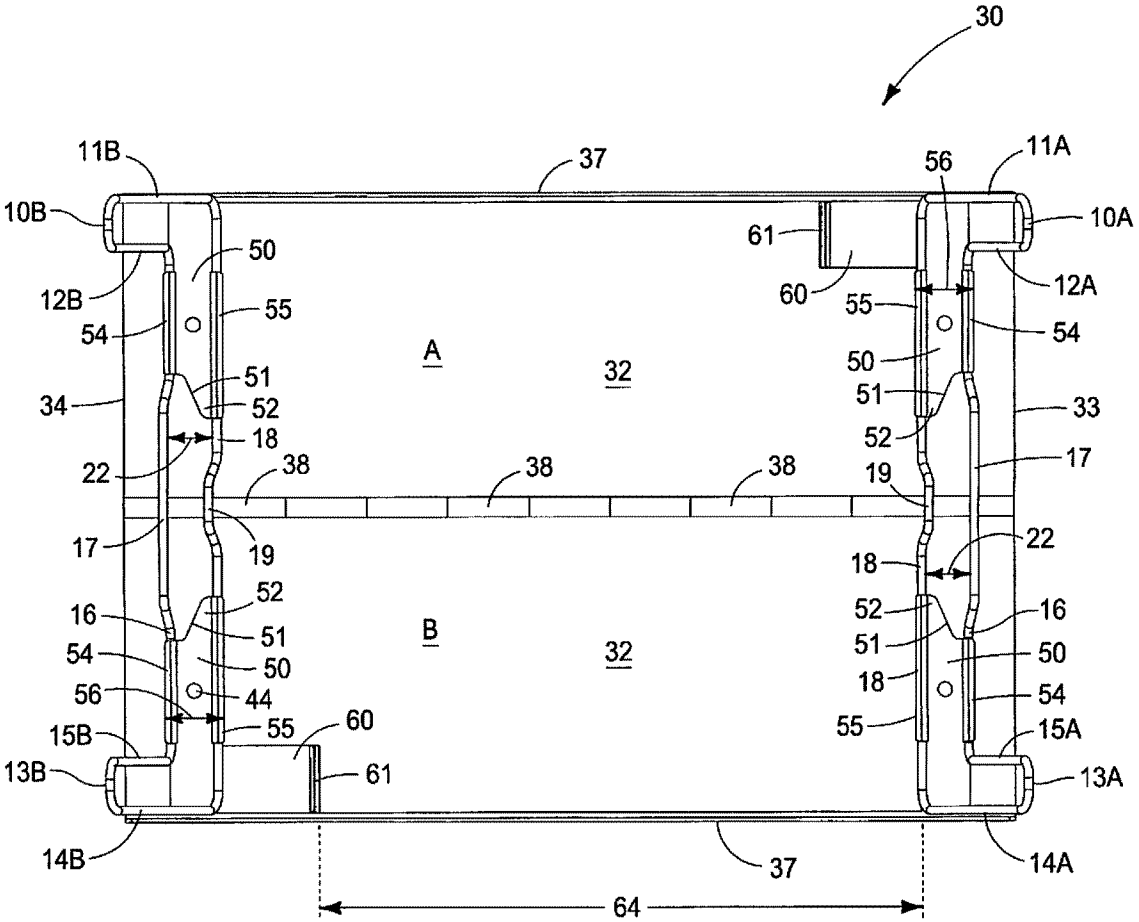
FIG. 4 is an orthographic bottom view of the table of FIG. 1.
Figure 6:
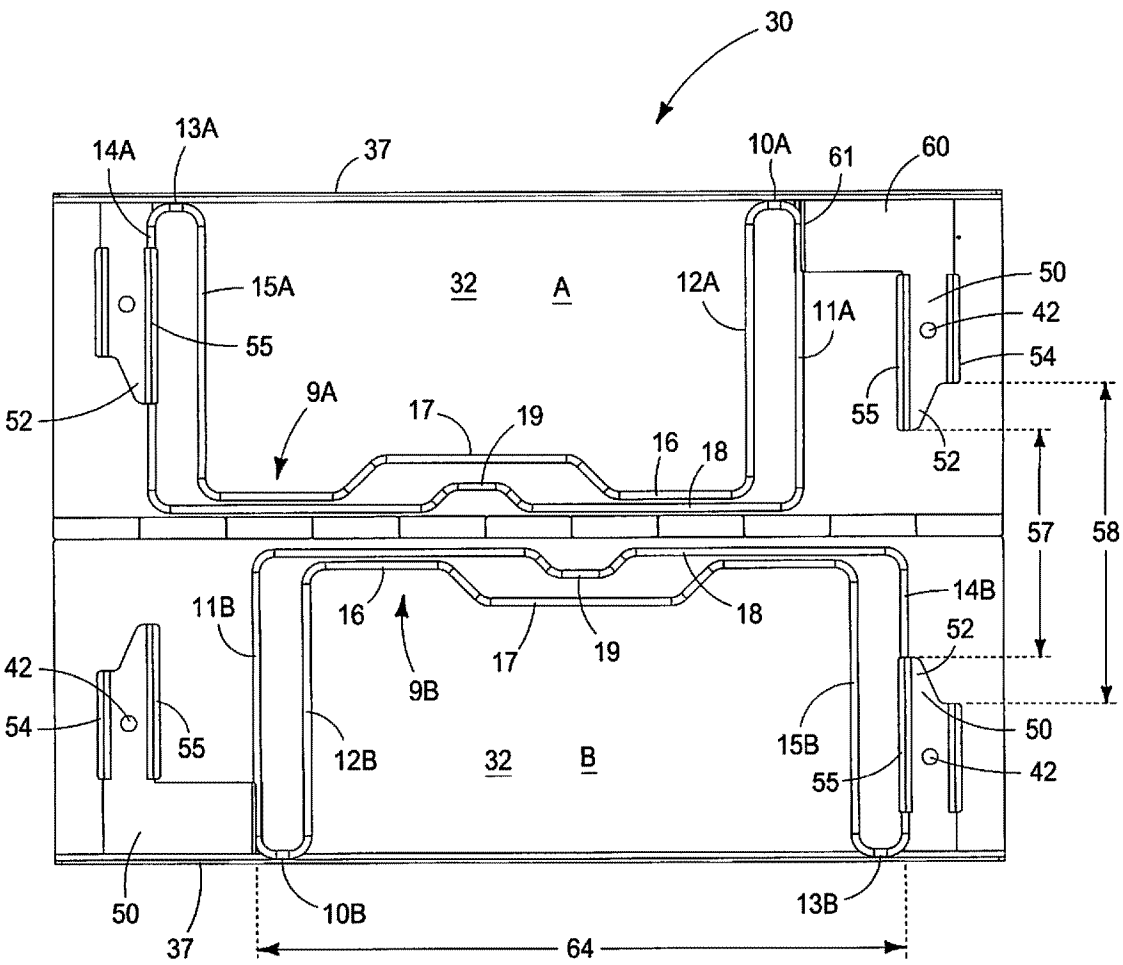
FIG. 6 is an orthographic plan view of a bottom surface of the instant folding portable table showing the leg assemblies in a storage configuration.
Figure 11:
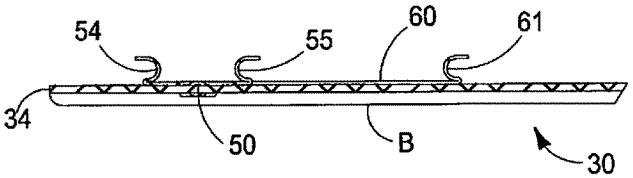
FIG. 11 is an enlarged end view of a leg assembly bracket showing the concave notches.

As shown in FIGS. 4 and 6, a leg assembly bracket 50 is carried on the bottom surface 32 of each table top halve 30A, 30B proximate each first end portion 33 and proximate each second end portion 34. Each leg assembly bracket 50 defines a first concave notch 54 that is proximate to the first end portion 33 of each table top halve 30A, 30B and also proximate to each second end portion 34 of each table top halve 30A, 30B. Each leg assembly bracket 50 further defines a second concave notch 55 that is spaced apart, inwardly from the first concave notch 54. Each concave notch 54, 55 (as shown in FIG. 11) is configured to releasably engage with the outer edge top rail 16 and with the inner top rail 18 of each leg assembly 9A, 9B when the leg assemblies 9A, 9B are engaged with the leg assembly brackets 50 to configure the table 30 four a standing/use configuration. (FIG. 1).

Each leg assembly bracket 50 further has a rotation leg 52 that extends along a side portion of each leg assembly bracket 50 defining the second concave notch 55.

Figure 2:
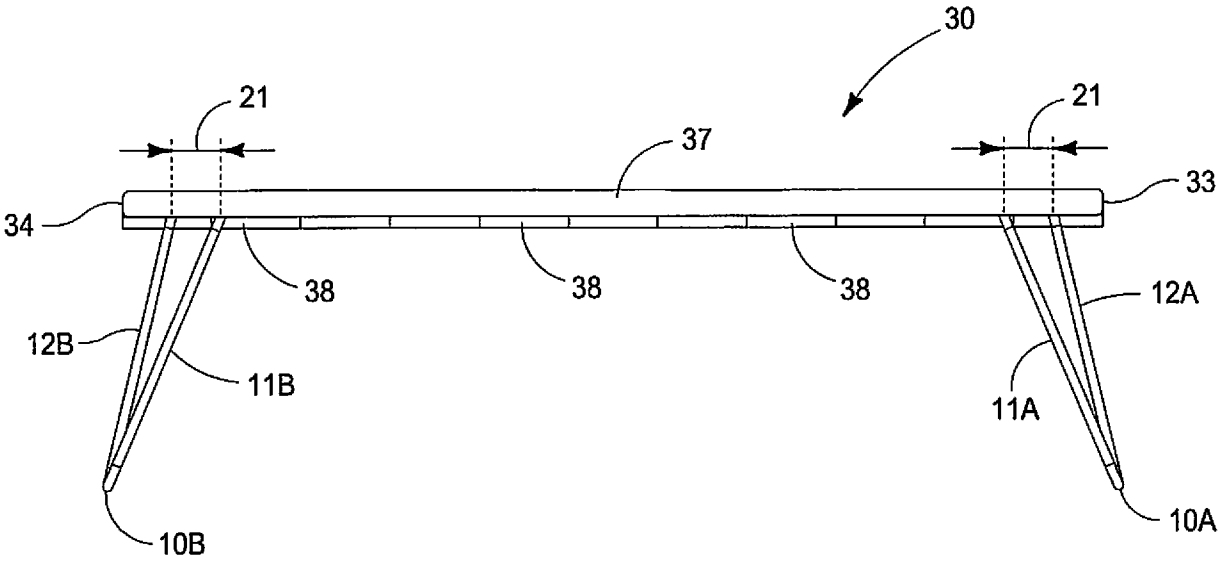
FIG. 2 is an orthographic side view of the table of FIG. 1.
Figure 3:
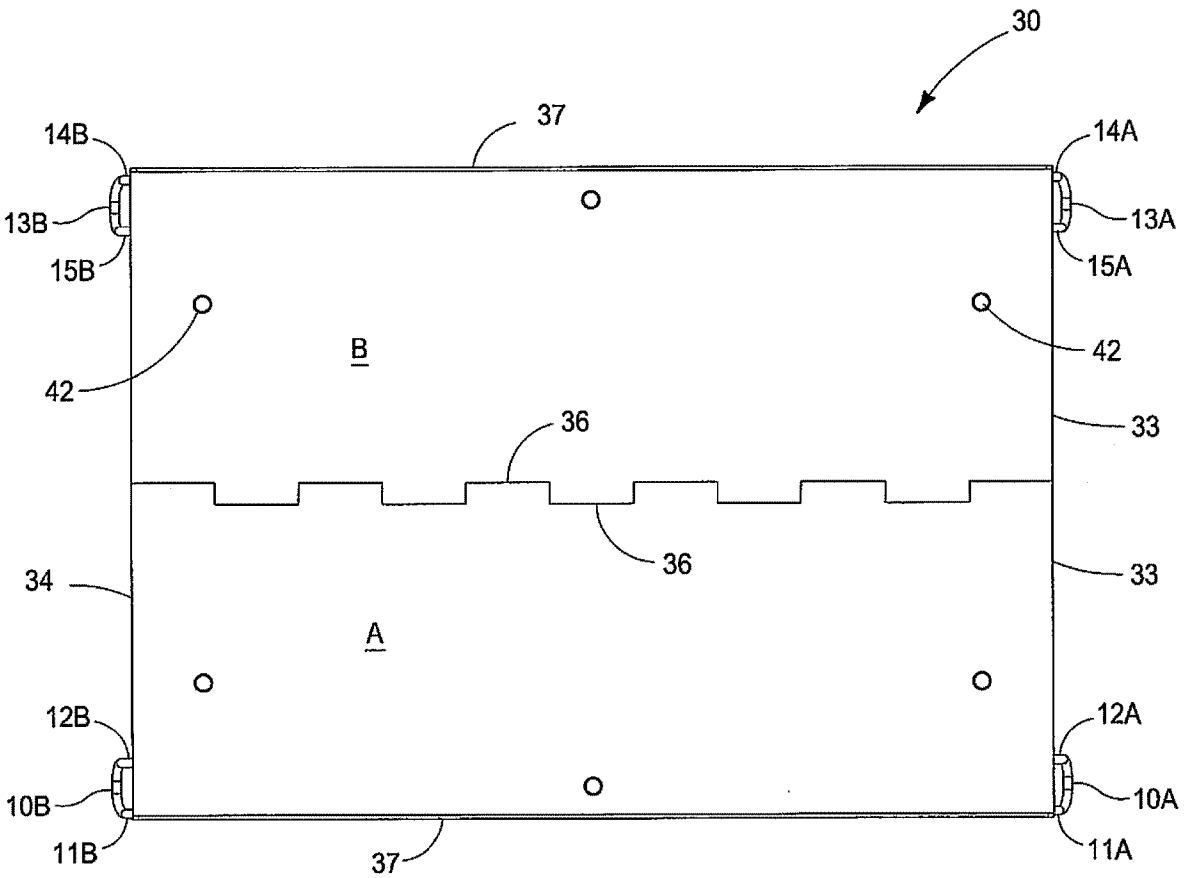
FIG. 3 is an orthographic plan view of the table of FIG. 1.

The leg assemblies 9A, 9B can be manually configurationally distorted such that the outer edge top rail 16 and the inner top rail 18 are moved opposite one another ("stretched" apart) so that the outer edge top rail 16, laterally outward of medial bend 17, engages within concave notches 54, and the inner top rail 18, laterally outward of medial bend 19, engages within concave notches 55. The retentive memory of the material forming the leg assemblies 9A, 9B causes the outer edge top rail 16 and the inner top rail 18 to be positionally secured within the concave notches 54 and 55. A tension offset of the outer edge top rail 16 from the inner top rail 18 is shown as 21 on FIG. 2. The tension offset 21 causes the first legs 11, 14 to be flexed inwardly toward a medial portion of the table top halves 30A, 30B, and causes the second legs 12, 15 to be flexed toward the end portions 33, 34 of the table top halves 30A, 30B, respectively.

As shown in FIG. 5, the medial bends 17, 19 defined by the outer edge top rail 16 and in the inner top rail 18 accommodate the hinge barrels 38 that extend generally downwardly from the bottom surface 32 of the table halves 30A, 30B.

Distance 58 (FIG. 6) between the proximate end portions of the first concave notches 54 defined in the leg assembly brackets 50 is approximately equal to distance 22 (FIG. 10) which is the length of medial bend 17 defined in the leg assemblies 9A, 9B. Distance 57 (FIG. 6) between adjacent end portions of rotation legs 52 is less than distance 58, and accommodates the medial bend 19 defined in the inner top rail 18 which has length 23. The different lengths 57, 58 and engagement with the leg assemblies 9A, 9B causes the leg assemblies 9A, 9B when flexed 21 to rotate relative to the table top halves 30A, 30B so that the first and second feet, 10, 13 (respectively) rotate somewhat outwardly toward the first end 33 and second end 34 of the table 30. The medial bends 17, 19 within the lengths 57, 58, as well as the downwardly protruding edge of the perpendicular lip 37 prevent the leg assemblies 9A, 9B from moving within the leg assembly brackets 50 towards the lateral outer sides 35 of the table 30 which might cause the table 30 to be unstable.

As can be seen in FIGS. 4 and 6, one leg assembly bracket 50 on each table top half 30A, 30B bottom surface 32 has an offset leg 60 that extends toward a medial portion of the table top half 30A, 30B. End portion of each offset leg 60 opposite the first concave notch 54, defines a storage concave notch 61 which facilitates positional storage of the leg assemblies 9A, 9B adjacent to the bottom surface 32 of each table top half 30A, 30B. As shown in FIG. 6, a portion of each first leg 11, proximate the first foot 10 engages within the storage concave notch 61, and a portion of each second leg 14 engages with the second concave notch 55 defined by the leg assembly bracket 50. This engagement provides secure positional storage of the leg assemblies 9A, 9B adjacent the bottom surface 32 of the table top halves 30A, 30B so that the leg assemblies 9A, 9B are not lost when the folding table 30 is not in use, such as during transport while backpacking. Dimension 64 (FIG. 6) is the distance between the storage concave notch 61 of each offset leg 60 and the opposing second concave notch 55 defined by each leg assembly bracket 50. Distance 64 is approximately the same distance between the first foot 10 first leg 11 and the second foot 13 first leg 14 of each leg assembly 9A, 9B.

Operation

Having described the structure of my folding portable table 30, its use is hereinafter described.

A user (not shown) would open the table 30 by disconnecting any fastening latch (not shown) and pivoting the first table top half 30A and second table top half 30B about the hinge pin 40 carried within the axially aligned hinge barrels 38 so that the top surface 31 of the first half 30A and the top surface 31 of the second half 30B are adjacent to one another and planar. Such pivoting and placement of the table 30 with the top surface 31 resting upon a supporting surface 100 positions the bottom surfaces 32 oriented upwardly as shown in FIG. 6. The leg assemblies 9A, 9B which are stored adjacent to the bottom surfaces 32 by releasable engagement with the storage concave notch 61 and the second concave notch 55 are then accessible. The leg assemblies 9A, 9B are removed from engagement with the storage concave notch 61 and the second concave notch 55 by flexing the leg assemblies 9A, 9B such as by forcing the first foot 10 toward the second foot 13 which will remove the adjacent first leg 11 from the engaging concave notch 61, 55.

Once the leg assemblies 9A and 9B are removed from the storage configuration on the bottom surface 32 of the table halves 30A, 30B, a user will grasp one leg assembly 9A and position the inner top rail 18 within the second concave notches 55 defined by each leg assembly bracket 50. When properly engaged, the inner top rail 18 is positioned within the second concave notch 55 and the medial bend 19 extends over the hinge barrels 38. The user will then grasp the medial bend 17 defined in the outer edge top rail 16 and pull/draw the medial bend 17 and outer edge top rail 16 toward the proximate end portion of the table 30 and into engagement with the first concave notch 54 of each leg assembly bracket 50. The drawing of the outer edge top rail 16 creates tension 21 between the rails 16, 18 and the retentive memory of the material forming the leg assembly 9A, 9B maintains the positional engagement of the leg assembly 9A, 9B within the concave notches 54, 55. The process is repeated for the remaining leg assembly 9A, 9B at the opposing end portion 33, 34 of the table 30 to engage the second leg assembly 9A, 9B within the concave notches 54, 55 defined by the leg assembly brackets 50 carried on the bottom surface 32 of the table halves 30A, 30B.

Once the leg assemblies 9A, 9B are engaged within the concave notches 54, 55, the table 30 may be inverted so that the feet 10A, 10B, 13A and 13B rest upon the supporting surface 100 and the top surface 31 of the table 30 is available for use.

I claim:

1. A folding portable table comprising:

a planar table top having a first half and a hingedly connected second half, each half having a first end portion, a second end portion, an outer side portion and an inner side portion, each half further having a top surface, and a bottom surface;

a hinge fixedly connected to each table top half along adjoining side portions to allow the planar table top to fold along the hinge;

a leg assembly bracket fixedly carried on the bottom surface of each table top half, each leg assembly bracket defining a first concave notch, and a second concave notch, each concave notch configured to engage with and positionally maintain a leg assembly; and a leg assembly for releasable engagement with the leg assembly brackets to support the folding portable table above a supporting surface, each leg assembly having a first foot and a spaced apart second foot, an outer edge top rail and an inner top rail and having legs communicating from opposing end portions of the outer edge top rail and the inner top rail with the first foot and with the second foot.

2. The folding portable table of claim 1 further comprising:

a storage latch carried by the table top halves to secure the table top halves in a storage configuration.

3. The folding portable table of claim 1 further comprising:

a perpendicular lip extending along the laterally outer side portion of each table top half.

4. The folding portable table of claim 1 further comprising:

a medial bend in the inner top rail of the leg assembly and a medial bend in the outer edge top rail of the leg assembly to facilitate aligned engagement with the leg assembly brackets.

5. The folding portable table of claim 1 further comprising:

a rotation leg defined in each leg assembly bracket adjacent the second concave notch to engage with a medial bend in the inner top rail to facilitate rotational alignment of the leg assembly relative to the table top.

6. The folding portable table of claim 1 further comprising:

an offset leg on at least one of the leg assembly brackets, the offset leg defining a storage concave notch to positionally secure the leg assembly adjacent the bottom surface of the table top half when the leg assembly is in a storage configuration.

7. The folding portable table of claim 1 wherein:

the hinge is plural spacedly arrayed hinge barrels structurally carried along the laterally inner side portion of each table half and each of the plural hinge barrels defines a medial channel extending elongately therethrough to carry a hinge pin therein and the plural spacedly arrayed hinge barrels carried on the laterally inner side portion of the first table top half are complimentary spaced with the plural spacedly arrayed hinge barrels carried on the laterally inner side portion of the second table top half so that the medial channels defined by the plural hinge barrels of both table halves are axially aligned when the first table half and the second table half are oriented adjacent one another so that the hinge pin extends simultaneously through the aligned medial channels to hingedly interconnect the first table top half with the second table top half to allow folding of the portable table.

8. The folding portable table of claim 1 wherein:

each leg assembly bracket is located proximate the first end portion and proximate the second end portion.

9. The folding portable table of claim 1 wherein:

the first foot having a first leg communicating with an inner top rail, opposite the first foot, and the first foot further has a second leg communicating with an outer edge top rail, opposite the first foot, the second foot also having a first leg communicating with the inner top rail, opposite the second foot, and the second foot further has a second leg communicating with the outer edge top rail, opposite the second foot.

10. The folding portable table of claim 1 wherein:

the inner top rail and the outer edge top rail of each spring leg assembly releasably engage with the first concave notch and the second concave notch of the leg assembly bracket to extend angularly from the bottom of the table top halves to support the table top halves above a supporting surface, and retentive memory of spring steel material forming the spring leg assemblies causes the spring leg assemblies to be positionally secured to the leg assembly brackets.

11. The folding portable table of claim 1 wherein:

the leg assemblies are formed of a material having retentive memory.

12. The folding portable table of claim 1 wherein: the leg assemblies are formed of spring steel.

13. The folding portable table of claim 1 further comprising:

an anti-slip coating on the first foot and the second foot.

14. A folding portable table comprising:

a planar table top having a first half and a hingedly connected second half, each table top half having a first end portion and a spaced apart second end portion, a laterally outer side portion and a spaced apart laterally inner side portion, each table top half further having a top surface, an opposing bottom surface and a perpendicular lip extending along the laterally outer side portion;

plural spacedly arrayed hinge barrels structurally carried along the laterally inner side portion of each table half and each of the plural hinge barrels defines a medial channel extending elongately therethrough to carry a hinge pin therein and the plural spacedly arrayed hinge barrels carried on the laterally inner side portion of the first table top half are complimentary spaced with the plural spacedly arrayed hinge barrels carried on the laterally inner side portion of the second table top half so that the medial channels defined by the plural hinge barrels of both table halves are axially aligned when the first table half and the second table half are oriented adjacent one another so that the hinge pin extends simultaneously through the aligned medial channels to hingedly interconnect the first table top half with the second table top half to allow folding of the portable table;

a leg assembly bracket fixedly carried on the bottom surface of each table top half proximate the first end portion and proximate the second end portion, each leg assembly bracket defining a first concave notch, and a spaced apart second concave notch, each concave notch configured to engage with and positionally maintain a spring leg assembly;

a spring leg assembly for releasably engagement with the leg assembly brackets at each end of each table top half, each spring leg assembly having a first foot and a spaced apart second foot, the first foot having a first leg communicating with an inner top rail, opposite the first foot, and the first foot further has a second leg communicating with an outer edge top rail, opposite the first foot, the second foot also having a first leg communicating with the inner top rail, opposite the second foot, and the second foot further has a second leg communicating with the outer edge top rail, opposite the second foot; and the inner top rail and the outer edge top rail of each spring leg assembly releasably engage with the first concave notch and the second concave notch of the leg assembly bracket to extend angularly from the bottom of the table top halves to support the table top halves above a supporting surface, and retentive memory of spring steel material forming the spring leg assemblies causes the spring leg assemblies to be positionally secured to the leg assembly brackets.

15. The folding portable table of claim 14 further comprising:

an offset leg on at least one of the leg assembly brackets, the offset leg defining a storage concave notch to positionally secure the leg assembly adjacent the bottom surface of the table top half when the leg assembly is in a storage configuration.

* * * * *